US006692317B2

(12) United States Patent
Poissonniere

(10) Patent No.: US 6,692,317 B2
(45) Date of Patent: Feb. 17, 2004

(54) WATER CRAFT PROPELLED BY A DOUBLE-FLIPPER DEVICE ACTUATED BY A PEDAL MECHANISM

(76) Inventor: Didier Poissonniere, 25, BD des Minimes, Bat. G, Le Gaillac, Toulouse (FR), F-31 200

( * ) Notice: Subject to any disclaimer, the term of this patent is extended or adjusted under 35 U.S.C. 154(b) by 0 days.

(21) Appl. No.: 10/257,768

(22) PCT Filed: Apr. 13, 2001

(86) PCT No.: PCT/FR01/01144

§ 371 (c)(1),
(2), (4) Date: Oct. 17, 2002

(87) PCT Pub. No.: WO01/79058

PCT Pub. Date: Oct. 25, 2001

(65) Prior Publication Data

US 2003/0092329 A1 May 15, 2003

(30) Foreign Application Priority Data

Apr. 17, 2000 (FR) ..... 00 04929

(51) Int. Cl.[7] ..... B63H 1/36
(52) U.S. Cl. ..... 440/15; 440/26
(58) Field of Search ..... 114/315; 440/13, 440/14, 15, 21, 26, 27

(56) References Cited

U.S. PATENT DOCUMENTS 2,180,890 A 11/1939 Weatherwax
2,317,905 A * 4/1943 Galkin ..... 440/26
2,728,298 A 12/1955 Shafer
3,570,436 A * 3/1971 Le Vasseur ..... 114/315
5,320,583 A 6/1994 van Wingen born Looyen

FOREIGN PATENT DOCUMENTS

| | | |
|---|---|---|
| FR | 2 602 483 | 2/1988 |
| FR | 2 752 214 | 2/1998 |
| GB | 2 272 415 | 5/1994 |

* cited by examiner

*Primary Examiner*—Stephen Avila
(74) *Attorney, Agent, or Firm*—Young & Thompson

(57) ABSTRACT

A rigid or inflatable water craft propelled by a double-flipper device for safe displacement both for the user and nearby swimmer.consists of a floater specifically linked to a propelling system comprising a pedal mechanism with discoid branches with protected pedals actuating two cog wheels secured to two rods connected by pivot pins and sliding in two tubes at the end of which are fixed aquatic flippers. The rotation of the cog wheels, acting as a reduction gear box, about the axles fixing them to the outer hull open in its rear part enables to obtain effortlessly a constant and continuous flapping movement of the flippers in a common vertical plane, such as that produced by a human and known to be most efficient. The device is particularly designed for the general public for use in an aquatic environment in the form of nautical activities for leisure, sport or exercise.

8 Claims, 3 Drawing Sheets

WATER CRAFT PROPELLED BY A DOUBLE-FLIPPER DEVICE ACTUATED BY A PEDAL MECHANISM

The present invention relates to a rigid or inflatable nautical vehicle which is propelled by a twin-paddled device. This device is actuated by a totally submerged crank gear with hollow legs which are of a disc-shaped form, the axis of which is connected to a mechanism which imparts a regular and continuous, undulating movement to two rods which each slide in a tube supporting the aquatic paddles which effect, by transmission of the aforementioned movement, a beating in parallel and in the opposite direction in the same vertical plane.

Nautical vehicles of this type traditionally comprise a floating support, comparable to a pole, to which the user is strapped, which in the event of an abrupt reversal can pose a danger to said user. The projecting parts of these vehicles can likewise pose a danger in choppy water conditions to swimmers situated in the vicinity. Corresponding propulsion systems of the same type, comprising a crank gear and a single- or twin-paddled device which are totally submerged, are produced either on the principle of a scull driven by a crank gear with a rectilinear action or by aquatic paddles which are attached directly on the actual pedals. In the first case, the force required to produce a to and from movement of the pedals is significant; in the second case, the propulsion effect of the paddles is reduced because of a beating which is of an elliptical type and not in the opposite direction, effected in the same vertical plane, following the example of that produced by humans and recognised as the most efficient.

The following nautical vehicle permits these disadvantages to be remedied.

It comprises a rigid or inflatable float which is completely or partially associated with a twin-paddled propulsion system which is actuated by a crank gear with hollow legs which are of a disc-shaped form and the pedals of which likewise comprise an adequate flexible protection. The float, having rounded shapes, is recessed on its rear part in order to allow the user to sit in a straddle position. The parts adjoining this recess comprise a slight elevation towards the front, an elevation which is more accentuated towards the rear and takes the place of a seat back, thus facilitating a position of the body which is bent in the direction of travel whilst efficaciously maintaining the lower part of the back without a special fixed attachment; the user, in a position bent towards the front, has the possibility of holding onto two handles which are attached to each side of the float in order to maintain his balance better. Steering is ensured by immersing the hand on the desired side with the palm vertical. The upper rear part contributes to the buoyancy; a fixed or removable fairing, protecting the propulsion system and open towards the rear in order to allow the beating of the paddles, forms the lower, rear part of the nautical vehicle. The hollow legs of the crank gear with a disc-shaped form likewise contribute to the buoyancy; they can be used furthermore as wheels for the transfer of the vehicle to dry land, which constitutes a further advantage. In this case, the vehicle is pulled by the handle, which is situated at the prow and provided for any possible attachment in the case of towing in an aquatic environment.

The twin-paddled vehicle comprises, according to a first characterising feature, a crank gear with two hollow legs which are of a disc-shaped form, with removable pedals and connected by its axle, comprising two toothed wheels, to two second wheels, likewise toothed and having a larger diameter, upon each of which there is attached laterally, in a diametrically opposite position, a pin; two rods pivot on the one hand on these pins and slide on the other hand in the interior of two tubes which are connected to the frame of the device by pivots; the aquatic paddles are attached to the end of these tubes. The four aforementioned toothed wheels comprise a reduction gearbox. Thus, when the user, in a semi-submerged position, actuates the crank gear, the retained mechanism allows the force to be reduced and communicates, by means of the sliding rods which at the level of the pins and in opposition describe one complete rotation, an alternation of movements, likewise in the opposite direction, of the two tubes on which the aquatic paddles are attached; this beating is limited to a simple pivoting movement about pivots because of the neutralisation of the pushing and pulling into to and from movements of the rods by sliding of these rods in the corresponding tubes; consequently the paddles effect a beating which is regular and in an opposite direction in the same vertical plane.

According to another embodiment, the four toothed wheels can be replaced by a connecting rod, taking the place of the axle of the crank gear, upon which connecting rod the two sliding rods pivot and are recessed upstream for this purpose. This embodiment produces the same result as the former, with the exception that the user is unable to benefit from a reduction in the deployed force.

The six attached drawings illustrate the invention. The first four relate to the propulsion mechanism, the last two to the floating vehicle which is indissociable from a better implementation of the aforementioned mechanism.

Figure 1:
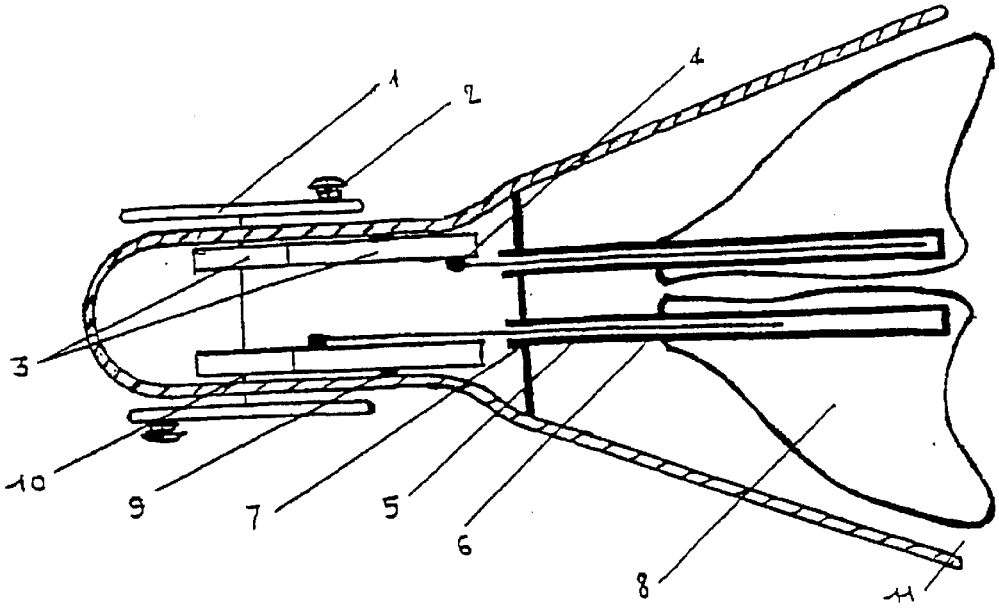
FIGS. 1 and 2 represent in section the complete propulsion mechanism.
Figure 2:
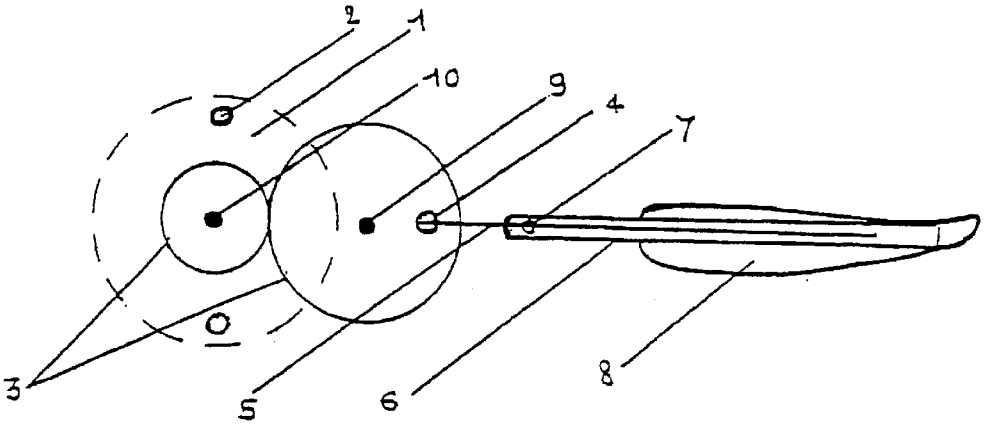

With reference to FIGS. 1 and 2, the propulsion device comprises a crank gear with hollow legs which are of a disc-shaped form (1), with removable pedals, the flexible material protection of which can form the convex and circular head of a locking screw intended to make the two parts (2) integral, the axle of which supports two toothed wheels enmeshing with two toothed wheels (3) which are of a larger diameter and are attached to the frame on one side only (9) in order to allow, in the central part, the free rotatory movement of the rods which are described later. Two pins are placed laterally on the aforementioned wheels in a diametrically opposite position (4); on these pins, the recessed heads of two rods (5) pivot, sliding in two tubes (6) which are themselves attached to the frame by pivots (7) so as to obtain a pivoting movement. The aquatic paddles are attached to the end of these tubes (8). The toothed wheels (3) form a reduction gearbox. The diameter of these toothed wheels and the length of the rods (5) are such that the rotation of said wheels, driven by the crank gear, communicates to the tubes (6), by means of the rods (5) and their friction and pressure on the internal walls of these tubes (6), a pivoting movement, comparable to a beating, passed on to the aquatic paddles which are integral with them (8). This beating, which is parallel and in the opposite direction, is effected in the same vertical plane, for the reasons described above, according the paddles (8) their entire efficiency. In this embodiment, the axle of the toothed wheels which support the sliding rods (9) and the pivots which support the tubes (7) must be situated in a horizontal plane in order to obtain the best efficiency of the paddles. In contrast, for reasons of industrial manufacture or for other reasons, the two axles of the reduction gearbox (9; 10) can be situated in different planes which are compatible with a normal operation.

The fairing protecting the propulsion device presents an opening (11) to the rear such that the aquatic paddles may beat there freely.

Figure 3:
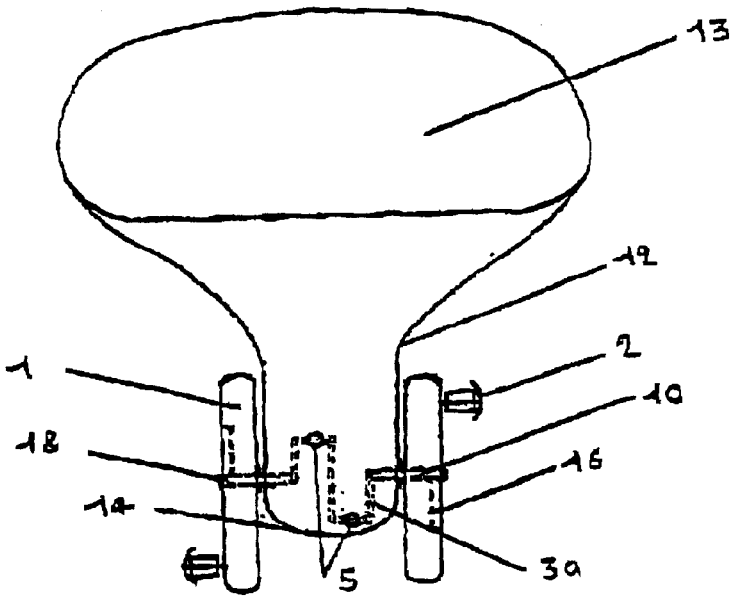
FIG. 3 represents a transverse section of the rear part of the nautical vehicle particularly emphasising the positoning of the crank gear and its variant in the form of a connecting rod.

According to a variant illustrated in dotted lines in FIG. 3, the reduction gearbox (3) is replaced by a connecting rod (3*a*) which serves as the axle for the crank gear; the two sliding rods (5) which pivot about the two opposite horizontal parts which are provided for that purpose can effect, upstream, one complete rotation during actuation of the crank gear by communicating to the two tubes (6) a movement of the same type as that shown by way of example in the first embodiment.

Figure 4:
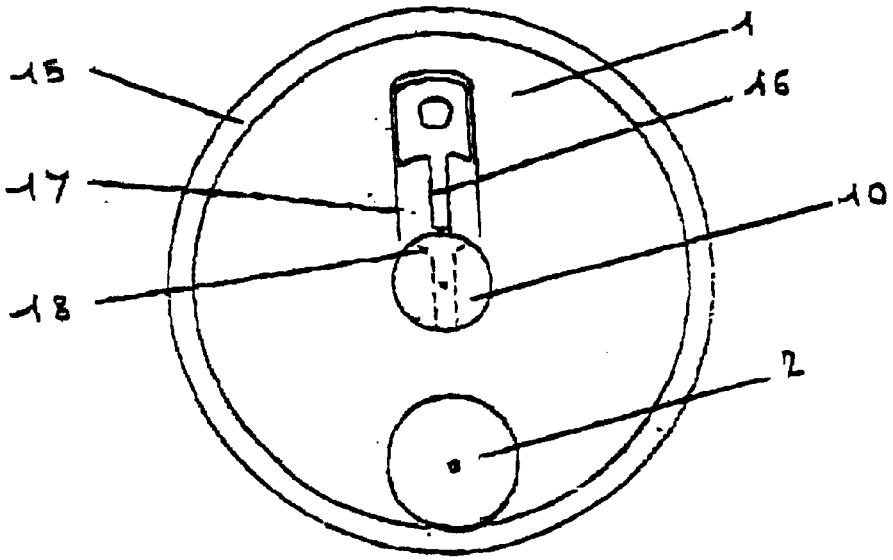
FIG. 4 represents a leg of the crank gear and its locking system.

With reference to FIGS. 3 and 4, the recessed fairing (12) which protects the propulsion device and is attached under the upper, rear part of the float (13) is produced in such a manner that its ground clearance suffices (14) to allow the legs of the crank gear (1) which are of a disc-shaped form to be used likewise as wheels. For this purpose, the circumference of these hollow legs which contribute to the buoyancy can be covered in a rubberised material (15). The locking and unlocking of these legs (1) from the axle of the crank gear (10) is ensured manually by a flattened hasp (16), punched out in order to allow the finger which slides in two fixed lateral slides (17) to pass through there. The axle of the crank gear (10) is recessed in a chamfer (18) in order to facilitate the passage of the lower part of the hasp and thus in order to make the two parts integral with each other. Reference marks can be provided on the visible section of these two parts in order to facilitate a rapid relative movement for locking.

Any flexible material protection of the pedals (2) can form the head of a locking screw in order to allow the possible removal of these pedals which are screwed into the body of the legs of the crank gear.

Figure 5:
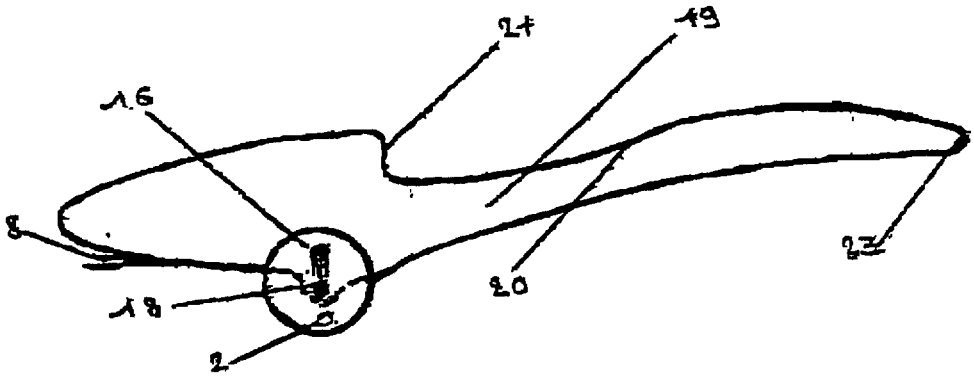
FIG. 5 represents a lateral view of the nautical vehicle.
Figure 6:
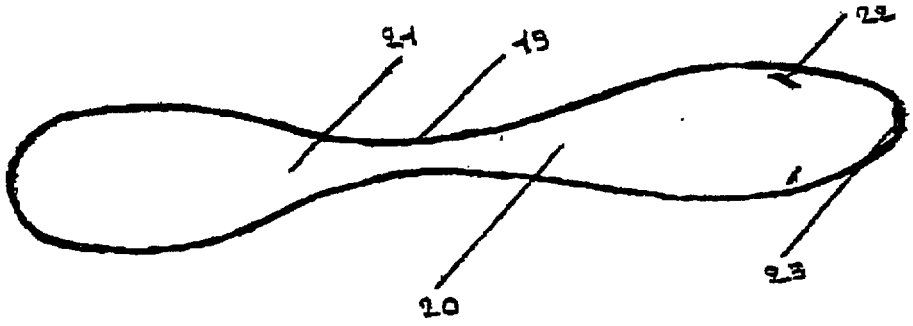
FIG. 6 represents a view from above of the nautical vehicle.

With reference to FIGS. 5 and 6, the rigid or inflatable float, which has a specific shape for optimum usage of the propulsion system in the best safety conditions, is recessed in its central part (19) in order to allow the user to position himself in a straddle position. The part situated towards the front presents a slight elevation (20) on which this user can support himself in a position bent in the direction of travel. Two handles are provided laterally (22) to enable holding on and the elevation which is situated to the rear (21) and forms a seat back supports the lower part of the back. Access to the pedals is facilitated by the recessing of the fairing mentioned above (12). A handle at the prow (23) is used both for possible towing in an aquatic environment and transfer of the float to dry land.

The nautical vehicle according to the invention is intended for the public at large for use in and around an aquatic environment in the sphere of nautical activities relating to leisure, sport and health.

What is claimed is:

1. Aquatic propulsion device adapted to a specific float, characterised by a submerged crank gear with hollow legs and of a disc-shaped form (1), with a rubberised circumference (15), the removable pedals of which comprise a flexible, convex and circular, lateral protection which is able to form the head of a locking screw.

2. Device according to claim 1, characterised in that the axle of the crank gear supports two toothed wheels, which enmesh with two other toothed wheels of a larger diameter (3), forming a reduction gear box, of which the larger are only connected to the frame laterally (9), and each internal face of which supports a pin (4) placed in a position diametrically opposite with respect to each other.

3. Device according to claim 2, characterised in that the four toothed wheels (3) can be replaced by a connecting rod (3*a*), the two horizontal parts of which are situated in a diametrically opposite position.

4. Device according to claim 1, characterised by two recessed rods (5), which are supported on the pins (4) or on horizontal parts of a connecting rod (3*a*), about which they effect a rotatory movement, each sliding in tubes (6) which are connected to the frame by pivots (7).

5. Device according to claim 4, characterised in that the rods (5) communicate to these tubes, by means of friction and pressure on the internal walls of the tubes (6), a pivoting movement which is parallel and in an opposite direction, which movement is transmitted to the aquatic paddles (8) which are attached at their end and are driven in the same vertical plane.

6. Device according to claim 1, characterised by a manual system of locking/unlocking comprising a flattened hasp (16), which slides in two fixed, lateral slides (17), and a crank gear axle, of which the edges of transverse recesses at the level of each leg of the crank gear (1) are produced as chamfers (18).

7. Device according to claim 1, characterised in that the rigid or inflatable float is recessed in its central, lateral part (19) and comprises, on both sides of this recess, a slight elevation towards the front (20) and one which is more accentuated towards the rear and forms the back of a seat (21) and also two handles which are disposed laterally at the front (22) and one handle at the prow (23).

8. Device according to claim 1, characterised in that the rigid or inflatable float comprises, at its rear part, a fairing which is fixed or removable, protects its propulsion system, presents a lateral recess in its lower part (12), possesses adequate ground clearance (14) and forms an open angle at its rear part (11).

* * * * *